United States Patent [19]

Tanaka

[11] Patent Number: 4,527,821

[45] Date of Patent: Jul. 9, 1985

[54] LATCH DEVICE FOR DOOR OR LID

[75] Inventor: Toshie Tanaka, Machida, Japan

[73] Assignee: Nifco Inc., Yokohama, Japan

[21] Appl. No.: 426,528

[22] Filed: Sep. 29, 1982

[51] Int. Cl.[3] ..... E05C 19/06; E05C 9/00

[52] U.S. Cl. ..... 292/19; 292/86; 292/170; 292/DIG. 31; 292/DIG. 38

[58] Field of Search ..... 292/19, 86, 83, 53, 292/49, 27, 30, 224, 227, 127, 337, DIG. 31, DIG. 38, 170, 85, 80-82, 84, 87, 336.3; 70/159-162

[56] References Cited

U.S. PATENT DOCUMENTS

| | | | |
|---|---|---|---|
| 3,479,075 | 11/1969 | Swanno | 292/19 |
| 3,767,244 | 10/1973 | Plaw | 292/227 |
| 3,791,045 | 2/1974 | Landis et al. | 292/19 X |
| 3,830,535 | 8/1974 | Read et al. | 292/DIG. 38 X |
| 3,907,346 | 9/1975 | Van Klompenburg | 292/127 |
| 3,918,754 | 11/1975 | Isbister | 292/DIG. 38 X |
| 4,022,504 | 5/1977 | Anderson | 292/DIG. 38 X |
| 4,362,036 | 12/1982 | Shanklin | 292/DIG. 38 X |

*Primary Examiner*—Gary L. Smith
*Assistant Examiner*—Russell W. Illich
*Attorney, Agent, or Firm*—J. R. Halvorsen; T. W. Buckman

[57] ABSTRACT

A latch device for a door or lid comprises a housing, a latch pawl one end of which is secured to the housing and the other end of which is configured to engage an edge of the door or lid, a latch body having a resilient piece for controlling the attitude of the latch pawl, a knob, and a connecting section disposed between the knob and the resilient piece to release the engagement of the latch pawl with the open edge through the resilient piece by pulling the knob.

6 Claims, 13 Drawing Figures

Fig_2(A)
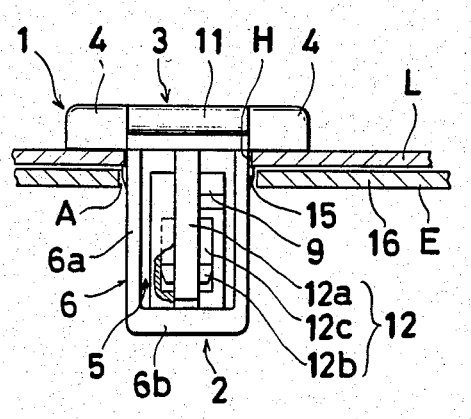
Fig_2(B)
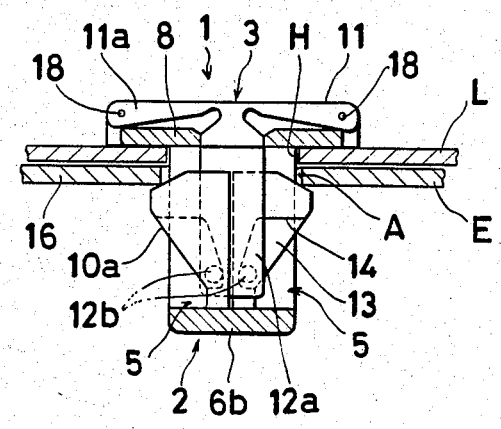
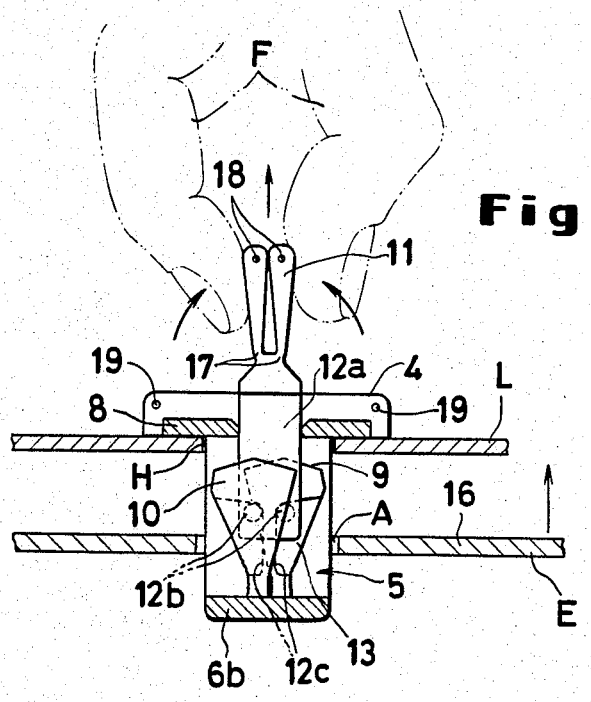
Fig_2(C)

LATCH DEVICE FOR DOOR OR LID

BACKGROUND OF THE INVENTION

The present invention relates to a plastic latch device for a door or lid, and particularly, to a latch device in which when the door or lid is closed, the door or lid, or said latch device, can be merely depressed towards an opening closed by said door or lid, and when opening, the door or lid may be opened with less resistance by pulling a knob section of the latch device.

Various latch devices for maintaining a door or lid in a closed state have been developed. Some of these are even made of plastic and some are convenient devices which can be operated merely by closing the door or lid. In this respect, these latch devices are substantially satisfactory. However, the force for maintaining the door or lid in a closed state and the opening force required when the door or lid is opened, i.e. the force required to overcome the first mentioned force, are equal to each other. The equality of these forces has been unavoidable since the latch is designed to prevent the door or lid from opening unexpectedly and therefore is given a large retaining force which must be overcome when it is opened intentionally. The result has been poor operability.

SUMMARY OF THE INVENTION

The present invention has been achieved in view of the foregoing, and it is an object of the invention to provide a plastic latch device wherein the required opening force is not increased even if the force for maintaining the closed state is increased, which plastic device maintains the merit of the conventional latch device which requires only a pushing operation to establish closure.

The other objects and characteristics of the present invention will become apparent from the further disclosure of the invention to be made hereinafter with reference to the accompanying drawings.

BRIEF DESCRIPTION OF THE DRAWINGS

FIG. 2(A) is a front view of the latch device of FIG. 1(A) mounted on a lid;

FIG. 2(B) is a side sectional view of the latch device of FIG. 1(A);

FIG. 2(C) is a side sectional view showing the state where a knob of the latch device of FIG. 1(A) is lifted;

DETAILED DESCRIPTION OF PREFERRED EMBODIMENT

The embodiment of the present invention will now be described in detail with reference to the accompanying drawings. The term "lid" is used herein to refer to both lids and doors.

Figure 1A:
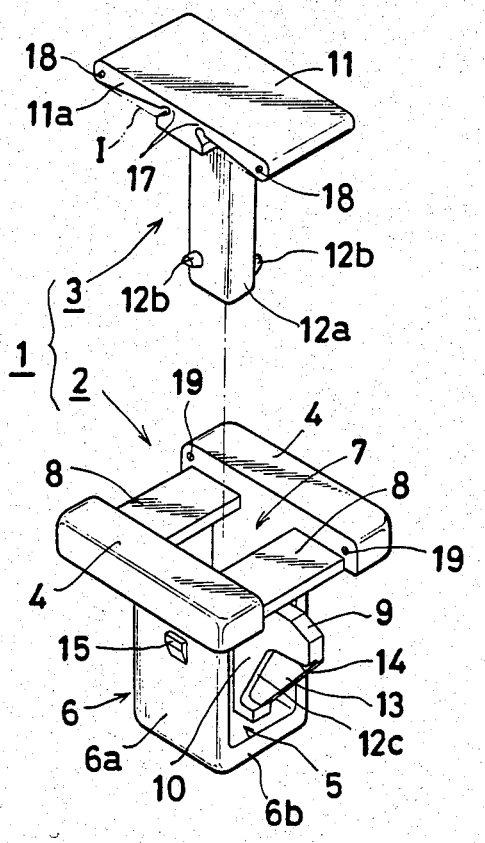
FIG. 1(A) is an exploded perspective view showing a first embodiment of a latch device in accordance with the present invention.
Figure 1B:
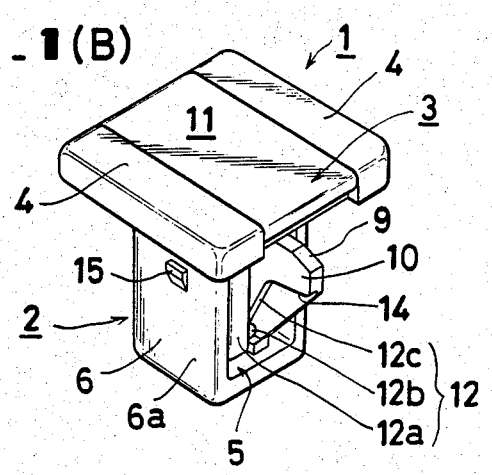
FIG. 1(B) is a perspective view showing the latch device of FIG. 1(A) in an assembled state.
Figure 1C:
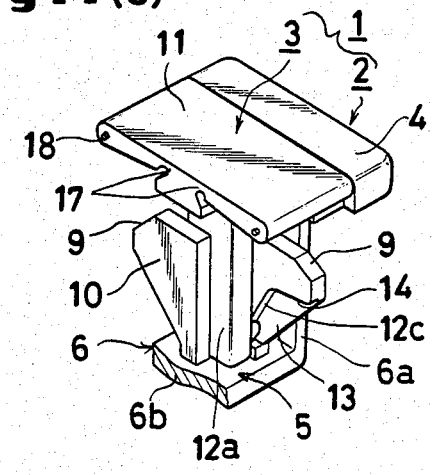
FIG. 1(C) is a partially cut-away perspective view showing the essential portion of the latch device of FIG. 1(A)

FIGS. 1–3 illustrate a latch device 1 as a first embodiment in accordance with the present invention. The latch device comprises two parts. That is, the device comprises a latch body 2 and a knob portion 3, which are separately molded of plastic. The latch body 2 has flanges 4 for riding on the surface of a lid L (FIGS. 2 and 3) to which this latch device is attached, and from the flanges is suspended a hollow housing 6 having an opening 5 into which latch pawls described later are projected. In this embodiment, for convenience in die preparation, the opening 5 is made to be larger than that required by the latch pawls, and the housing 6 is made in the form of a substantially U-shape comprising a pair of side walls **6*a* suspended from the flanges 4 and a bottom plate 6*b* connecting the lower portions of the side walls. In this case, the housing 6 as well as the flanges 4 are rectangular in cross-section, the flanges 4 are arranged along opposite upper edges of the side walls 6*a* of the housing, and a knob 11** described later is inserted between the flanges. The illustrated configuration aims at presenting a pleasing external appearance and not all of its features are not essential. The shape of the flange and knob is not essentially limited, and the housing can be made circular or of other shape.

The hollow portion of the housing 6 has an upward opening 7 in the plane of the flanges 4, and the opening has, on its opposite sides, reinforcing frames 8 which connect between the side walls **6*a* of the housing and the flanges 4**. However, these frames can be omitted if strength is not a problem.

From the openings on the sides of the housing are projected a pair of latch pawls 9 arranged back to back. The latch pawls 9 may be changed in attitude between a first attitude wherein they are projected externally of the housing as described above (FIGS. 1 and 2(B)) and a second attitude wherein they are withdrawn into the housing (FIG. 2(C)). The latch pawls 9 are formed on the free ends of resilient pieces 10 the bases of which are secured to the bottom plate **6*b* of the housing. As a result, when the latch pawls 9 are in the second attitude they are urged to return to the first attitude. That is, the resilient pieces 10 are rotated about a connection base relative to the bottom plate 6*b* between the substantially upright first attitude, and the inwardly inclined second attitude to thereby permit the latch pawl 9** to be moved in and out.

The resilient pieces 10 and the latch pawls 9 are offset laterally from each other as seen when viewed from opening 5 (FIG. 2(A)) and also offset in the transverse direction of the opening 5 (FIG. 2(B)). This arrangement is used for convenience in preparation of dies for plastic molding and to facilitate accommodation of connecting member provided on the knob portion 3 as described later.

Next, the knob portion 3 will be described. The knob portion 3 has a knob 11 which is held by the operator when he opens the lid, and the knob 11 in this embodiment may be changed in configuration insofar as the operator can easily hold it. A basic configuration of the knob is a flat plate set between the pair of spaced flanges 4 of the body 2 and riding over the reinforcing frames 8. This knob 11 and the resilient pieces 10 previously mentioned are connected and operatingly associated by means of a connecting portion 12. In this embodiment, the connecting portion 12 comprises three members 12*a*, 12*b* and 12*c* which will be described in the following.

First, there is provided a plate-like lever member 12*a* suspended from the central portion of the lower surface of the knob 11. When the knob 11 separately molded is set between the flanges of the latch body 2, the lever member 12*a* is inserted into the hollow portion of the housing from the upper opening 7 of the housing 6 and placed in the clearance between the pair of resilient pieces 10 (FIG. 1(C), FIG. 2(A)). The lever member 12*a* is made wide enough to overlap with both the resilient pieces 10 offset from each other in the direction of the opening 5 of the housing as may be best shown in FIG. 2(B). The lever member is provided on both sides of the lower portion thereof with projections 12*b* (accordingly, these projections are also displaced laterally with FIG. 2(B) viewed from the front) respectively projecting towards the resilient pieces. The side of each resilient piece is provided with a cam 12*c* for engagement with the corresponding projection 12*b*.

These cam surfaces are formed as a part of the peripheral wall surface of a groove 13 formed in the resilient piece 10 and constitute a downwardly inclined surface, that is, overhung surfaces which extend upwardly towards the opening 5 of the housing as they extend from the side near the base of the resilient piece toward the free end. The upper end of the cam surface terminates in the ceiling surface of the peripheral wall of the groove 13, the ceiling surface being in the form of a stopper surface 14 adapted to stop the movement of the projection 12*b* and then the movement of the knob 11 as will be described later.

In assembling the knob portion 3 with the latch body 2, including the process wherein the lever member 12*a* is set between the resilient pieces 10 as previously mentioned, the projection 12 is forcibly inserted between the resilient pieces 10 so as to forcibly spread them until the projections 12 are fitted within the grooves 13 of the resilient pieces 10 into engagement with the cam surface 12*c*, and therefore, the lower surface of the projection 12 can be tapered as best shown in FIG. 2(A) to effect the invasion smoothly.

Once the knob portion 3 and the latch body 2 have been assembled as described above, the projections 12*b* are set within the grooves 13 of the resilient pieces 10 and the lever member 12*a* is held on both sides by the surfaces of the resilient pieces to provide a stabilized support thereof. In addition, in this embodiment, since the side edges of the lever members are held as shown in FIG. 2(B) even by the confronted edge surfaces of the reinforcing frames 8 as previously mentioned, there is no play, merely allowing the vertical movement of the entire knob portion 3.

Next, in use of the present device 1, first the latch body with the knob portion incorporated from the surface side of the lid L is inserted into a mounting hole H in the lid L and mounted so as to be passed through the rear side until the flange 4 rides on the surface to make it integral with the lid. While to this end, the mounting means may be of any suitable means such as screw attachment, adhesion or the like, there are provided, in this embodiment, in consideration of convenience of operation, locking pawls spaced by a distance equal to or somewhat smaller than a wall thickness of the lid L from the lower surface of the flange on the outer side of the side walls 6*a* of the housing 6 so that the body is restored by the resiliency of the material at a position where the body is forcibly driven into the mounting hole H and the body is mounted on the lid L while being forcibly held by the locking pawls and flanges as shown in FIG. 2(A). Alternatively, only the latch body 2 can be mounted on the lid before the knob portion 3 is incorporated, and thereafter the knob portion can be incorporated by the procedure already described.

On the other hand, the opening edge E of the interior of a container closed by the lid is provided with engaging edges 16 placed in engagement with the latch pawls 9, respectively, as will be described hereinafter. However, in this embodiment, these engaging edges are formed as both side edges of the opening of a through hole A, as best shown in FIGS. 2(A)–2(C) and FIG. 3(B), and therefore, the following description will sometimes refer to the body 2 being forced into the through hole A.

For convenience's sake, the description will be started with the condition of the lid L being closed. In this closed condition, the latch pawls 9 extended outwardly through the openings 5 from the housing 6 of the present latch device 1 mounted on the lid L are extended on the rear surfaces of the engaging edges 16 of the open edge E. As viewed from the surface, and as may be better understood particularly from FIG. 3(A), this embodiment gives the impression that the knob 11 is integral with the flanges 4. As there are few portions projecting from the lid L, the device has a refined external appearance.

When the lid L is opened from this state, the operator holds the knob 11 by his fingers F (FIG. 2(C)) to lift the lid.

Figure 3A:
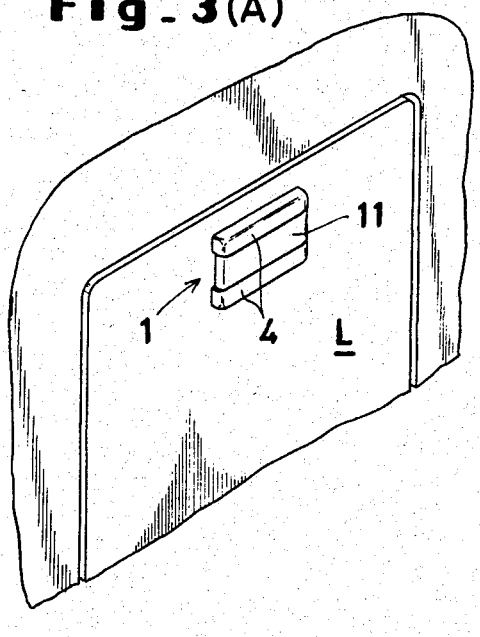
FIG. 3(A) is a perspective view showing a lid provided with the latch device of the first embodiment in its closed state.
Figure 3B:
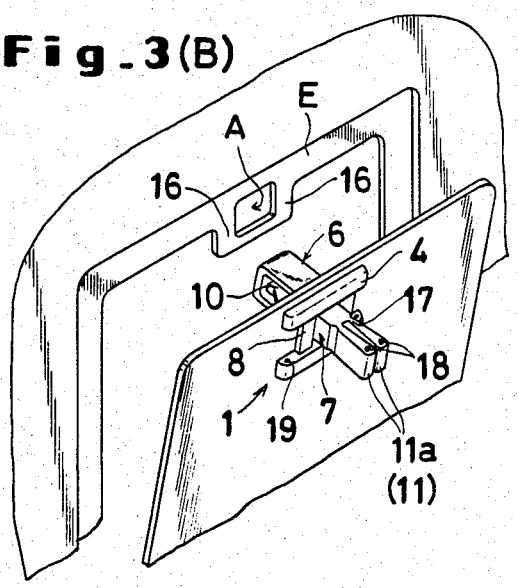
FIG. 3(B) is a perspective view showing a lid provided with the latch device of the first embodiment in its open state.

In this embodiment, the knob is normally set in the form of a flat plate between the flanges as previously mentioned but when an attempt is made by the operator to hold and lift both sides of the knob, the knob 11 is, due to the provision of hinges 17 formed by being made to have a thin wall thickness in the neighborhood of both sides of the root of the lever member 12*a*, deformed as shown in FIG. 2(C) and FIG. 3(B), so that approximately halves thereof are folded onto each other outwardly around the hinges, and thus, a rear surface 11*a* thereof having a relatively large area so far hidden forms a surface which can be easily held.

When the knob 11 is lifted, the lever member 12*a* naturally moves up and the projections 12*b* also moves up. Then, as the projections 12*b* move up, the cam surfaces 12*c* engaged therewith, which have been restrained at the position of the projection 12*b* with the result that they are inclined outwardly as they move upward, are made to stand up. Thus, the resilient pieces are each inwardly rotated about the connection base to the bottom plate 6*b* of the housing, whereby the latch pawls 9 are drawn into the housing to release the engagement with the engaging edges 16.

Accordingly, the lid L is opened by the same series of pulling operations starting with lifting of the knob 11, as shown in FIG. 2(C) and FIG. 3(B).

When the open lid L is closed, the lid L itself (or the knob) may merely be pushed toward the open edge E.

That is, when the operator stops lifting the knob 11 and releases his hand therefrom after the lid L has been opened as previously mentioned, the resilient pieces 10 returned to their original state by the resiliency of the resilient pieces 10 as already described, to pull down the lever member 12*a* through the projection 12*b* and to project the latch pawls 9 externally of the housing, and therefore, the lid L is pushed towards the open edge E in that condition and the portion on the rear side of the lid L of the present device 1 is again put into the through hole A, whereafter the tapered side edges 10*a* (FIG. 2(B)) below the resilient pieces leading to the latch pawls 9 impinge upon the engaging edges 16 and the resilient pieces 10 pass through the through hole A while relatively inwardly being flexed at the engaging edges 16. And, when the latch pawls 9 pass beyond the engaging edges, the resilient pieces are restored and locked at the rear surface thereof, thus returning to the initial state of the present operation where the lid L remains closed. However, since the engagement between the cam surface and the cam crest is released when the latch pawls 9 pass through the engaging edges, the knob remains immovable.

If the fingers are released, the knob 11 itself is also returned to its original plate-like configuration by the resiliency of the material. However, in order to maintain the external appearance when closed in a good condition, in consideration of the fatigue of the hinges 17 and the like, for example, small projections 18 are provided on both sides of the knob 11 and recesses 19 removably receiving therein the projections are disposed on inner portions corresponding to the flanges 4 (or the projections are provided reversely of the recesses) so that the knob 11 may be lightly depressed to snap-fit each of the projections in each of the recesses 19 so as to maintain the condition facing to the flange 4.

It should be noted that the shape of the knob 11 is not limited to that of this embodiment and the knob need not be particularly folded into two sections, and a mere flat plate as shown by the dotted lines I in FIG. 1(A), and handles, buttons, etc, such as normal drawer knobs or other knobs may be suitably used.

Further, pairs of resilient pieces and latch pawls are not always necessary and one of each will suffice. As for the position about which the resilient pieces rotate, any position may be employed as long as the latch pawl may be moved in and out therethrough.

In the above-described embodiment, the latch body 2 and the knob portion 3 are separately molded of plastic, and the movement of the knob 11 is associated with the retraction of the latch pawls by the connecting section 12 comprising three connecting members 12*a*, 12*b* and 12*c*. However, in the succeeding embodiment shown in FIG. 4(A) and thereafter, the entire device 1 is made to be a one-piece structure by molding the housing in a developed state and by forming the connecting section 12 by a fixed connecting lever 12*d*.

Figure 4:
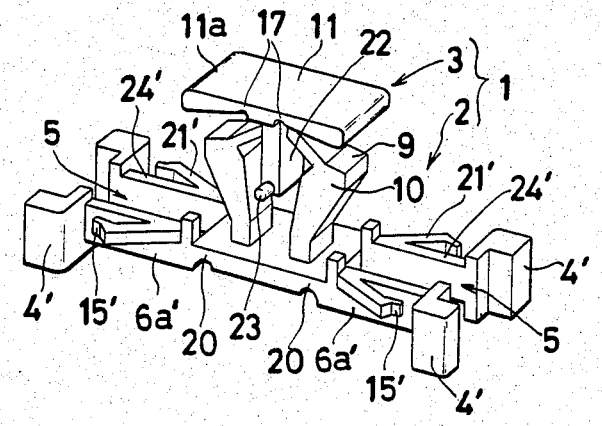
FIG. 4(A) is a perspective view showing a second embodiment of the latch device of the present invention in the unassembled state.
FIG. 4(B) is a perspective view showing the latch device of FIG. 4(A) in the assembled state.
FIG. 4(C) is a perspective view showing the opening operation of the latch device shown in FIG. 4(B)
Figure 4:
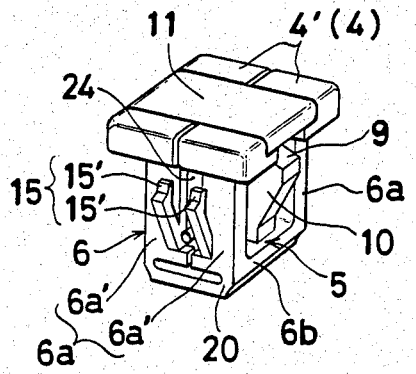
Figure 4:
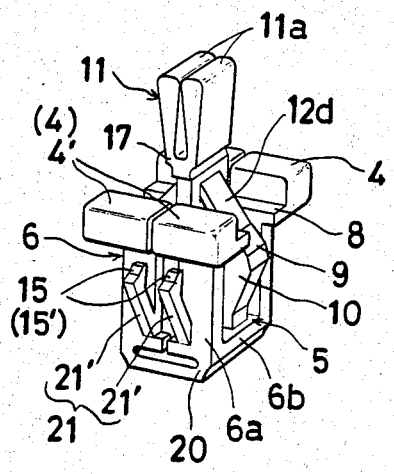

FIG. 4(A) shows the present device 1 in a developed state after the molding has been completed. Elements corresponding to those of the preceding embodiment have been given the same numerals. In this embodiment, the side wall 6*a* of the housing is divided into two halves 6*a*′ substantially in the central portion thereof, each half being connected at the lower end thereof to the bottom plate 6*b* of the housing by means of a hinge 20 and being open substantially in the same plane as that of the bottom plate 6*b*. With this, the flange 4 molded at the upper portion of the side wall of the housing is also divided into a pair of halves 4′.

Also in this embodiment, the body 2 may be mounted on the lid L by the resilient pawls 15. However, since the side wall 6 of the housing is likewise divided into two halves, the resilient pawls 15 mounted on the outer surface thereof are molded on the half of each housing side wall in the form of vertically split two halves 15′. The resilient locking pawl 15 in this case employs the shape of the so-called anchor type fastener in order to have a greater flexibility than that of the previous embodiment to increase the allowable manufacturing tolerance of the opening dimension of the mounting hole H of the lid L. That is, a resilient arm 21 (halves 21′) extended obliquely outwardly from the side wall 6*a* (halves 6*a*′) of the housing is formed at its free end with the locking pawl 15 (halves 15′), and the resilient arm is restored after passing through the mounting hole H of the lid L, whereby the locking pawl 15 is engaged with the hole edge thereof to mount the body 2 on the lid L.

From the upper surface of the bottom plate 6*b* of the housing are stood upright a pair of resilient pieces 10, on the free ends of which are provided latch pawls 9 projected from the openings 5 on both sides of the housing after assembly, which construction is similar to that of the previous embodiment. However, in this embodiment, the housing is intended to be formed by plastic injection molding in its developed state, and therefore, there poses no problem in punching with the result that even when the latch pawl is retracted, there is no crossing in dimension, and both the latch pawls are designed to have substantially the same width with the opening 5 viewed from the front.

The knob 11 in the knob portion 3 employed herein is in the form of a knob similar to the previous case, which can be folded into two sections, that is, in which portions 11*a* ahead of the hinges 17 on both sides in the central portion are upwardly folded through the hinges so that the knob may be readily held. However, the connecting section 12 by which the latch pawls 9 are retracted when the knob 11 is lifted comprises a connecting lever 12*d* of a predetermined length ends of which are fixed obliquely over the lower surface in the central portion of the knob 11 and the upper portion of each resilient piece.

The procedure of mounting the body on the lid L will be first described and the operation of the connecting section which will be described later. The halves 6*a*′ of the side walls of the housing molded in the developed state are rotated about the hinges 20 and raised to form a box-like configuration as a whole, as shown in FIGS. 4(B) and 4(C). As a result, the interior of the housing 6 is hollow, similarly to the previous embodiment, the latch pawls 9 are projected from the openings 5 on both sides thereof, and the knob 11 is just set between the flanges 4. However, in such condition, when the hand is released, each half of the side walls of the housing is returned to its original developed state by the resiliency of the hinge 20, and therefore, the halves mated together are inserted into the mounting hole H of the lid L through the end of the housing, the resilient arm 21 is passed therethrough while flexing towards the side walls of the housing at the hole edge thereof, and the halves are returned to their original state when passed through the hole edge to permit the locking pawl to engage said hole edge. In this manner, the side walls of the housing are prevented from development by the hole edge of the mounting hole, and as a consequence, the present device 1 may be finally mounted on the lid L similarly to the previous embodiment, as shown in FIGS. 5(A) and 5(B).

It should of course be appreciated that if necessary, in order to maintain the state of temporary assembly wherein the halves of side wall of the housing are folded into two sections to form a housing, a member for anchoring two plastic molded articles of this kind such as a hook member engageable with both the halves may be provided in a well known manner.

Figure 5:
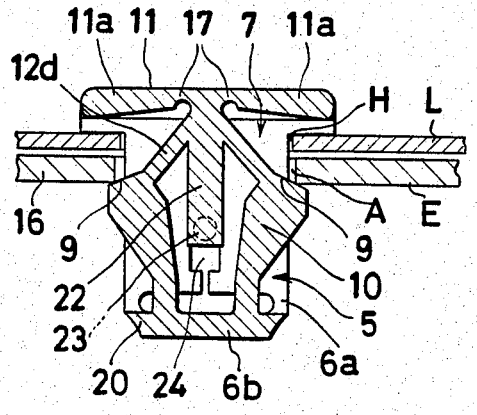
FIG. 5(A) is a side sectional view showing the closed state of the latch device of FIG. 4(B) mounted on a lid.
FIG. 5(B) is a side sectional view showing the open state of the latch device of FIG. 4(B) mounted on a lid.
Figure 5:
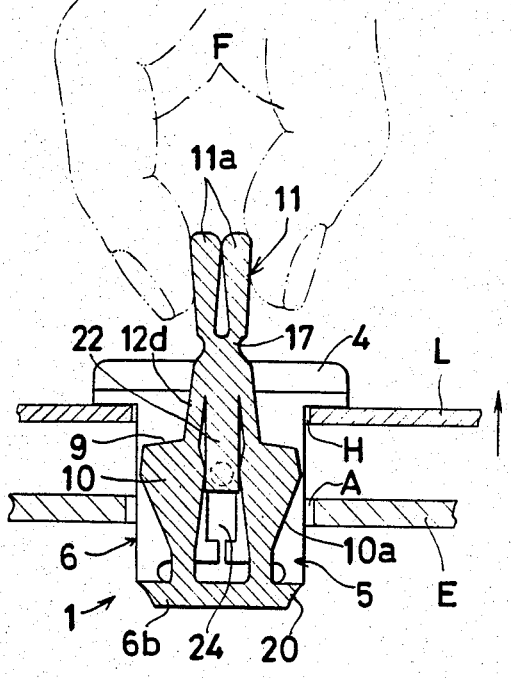

FIG. 5(A) shows the state wherein a latch pawl 9 engages an engaging edge 16 of an open edge E of a container or the like to close the lid L, which is the same state as that of the first embodiment shown in FIG. 3(A).

When the operator holds and lifts the knob 11 with his fingers F (FIG. 5(B)), the connecting lever 12*d* in its entirety is naturally moved upwardly but the resilient pieces 10 on the other side are locked vertically and the connecting lever 12*d* has a given length. Therefore, the connecting lever 12*d* is unavoidably displaced in height from the angle in the previous oblique state with the result that the resilient pieces 10 are inwardly displaced so as to come closer each other.

Accordingly, the latch pawls 9 are retracted into the housing 6 and thereafter the lid L can be opened similarly to the previous embodiment.

Also, the lid may be closed in a similar manner, and the latch pawls are moved beyond the engaging edges 16, after which they are restored at the rear surfaces thereof thereby returning to the state as shown in FIG. 5(A).

This embodiment is somewhat different from the previous embodiment in that as the latch pawls inwardly move when the lid is closed, the knob 11 is also projected slightly outwardly at that time. However, this is a difference in movement, and no essential difference in function is involved.

While in this second embodiment, a boss and a small hole are not provided to temporarily maintain the knob 11 in a flat state, it should of course be appreciated that the elements can be provided as in the previous embodiment.

Conversely, in this second embodiment, in order to more successfully prevent play of the knob 11, there are provided guide projections 23 laterally of a suspended member 22 suspending from the lower surface of the knob and a guide groove 24 on the side of the side wall of the housing to guide the side wall vertically (thus, at molding in the developed state, portions 24' at which the groove is disposed are also formed in the surface in which the halves of the side wall are in abutment with each other). But, this arrangement is of course convenient.

The significant characteristic of the latch device 1 in accordance with the present invention lies in that even if the length of the latch pawl 9 extended in the direction along the rear surface of the engaging edge 16 is made to be great to increase the force for maintaining the closed state of the lid L, the latch pawls are positively retracted when the lid is opened and therefore the opening force will not be increased, and the present invention further has a great advantage in that the pulling operation effected to open the lid naturally results in retraction of the latch pawls, thus merely requiring a single operation.

What is claimed is:

1. A plastic latch device adapted for mounting in an apertured door or lid, comprising: a latch body having (1) a flange-like head and a depending stud-like hollow housing including snap engaging means for mounting by telescoping in the aperture of said door or lid, said housing having an opening on opposite sides thereof and including a pair of axially extending spaced side walls interconnected at their free end opposite said head by endwall means, said spaced sidewalls defining said opposite openings, (ii) at least one latch pawl one end of which is resiliently secured by suitable means to said housing endwall means and the other of which is configured to extend laterally from within said housing and adapted to extend through said opening engage an edge of an opening penetrated by said stud-like housing and closed by said door or lid, and (iii) said suitable means including a resilient piece capable of assuming a first attitude wherein said at least one latch pawl is normally projected from an opening at the side of said housing and a second attitude wherein said pawl is retracted inwardly of the housing, said resilient piece normally being urged to assume said first attitude; a knob including a head portion normally positioned adjacent said flange-like head and adapted to be gripped by an operator; and a connecting section disposed between said knob head portion and said resilient piece to move said resilient piece from said first attitude to said second attitude by axially pulling said knob portion away from said housing head said latch body flange-like head being recessed to accept said knob head portion in flush array, said knob head portion being normally flat and generally perpendicular to said connecting section, said knob head portion further including at least one centrally disposed transverse hinge line whereby oppositely extending margins of said knob can be brought into juxtaposed relationship generally coaxial with said connecting section for gripping by said operator

2. A latch device of the type claimed in claim 1 wherein said connecting section is a blade-like member disposed between a pair of said resiliently mounted latch pawls, means interconnecting said blade-like member and said pawls whereby axial movement of said knob away from said housing causes said pawls to move laterally inwardly.

3. A latch device of the type claimed in claim 2 wherein said connecting section includes a pair of projections extending in opposite directions from said blade-like member, cam means in each of said pawls engageable by said projections, axial movement of said connecting section causing movement of said projections along said pawls and causing them to move into said housing confines.

4. A latch device of the type claimed in claim 2 wherein said connecting section includes a connecting lever extending from said blade-like member to each of said pawls and connected to said pawl at a point spaced from said resilient piece, said lever being initially disposed obliquely relative to the axis of said latch, axial movement of said knob away from said housing causes each said connecting lever to move inwardly into substantially parallel relation to said connecting section and thereby retracting said pawls into said housing.

5. A latch device of the type claimed in claim 4 wherein said housing, said pawls and said knob with its connecting section are fabricated as a one piece plastic device.

6. A latch device of the type claimed in claim 5 wherein said housing sidewalls are bifuracted and hingedly connected to said endwall, each of the bifurcated sidewall portions including a resilient snap retaining means spaced from said flange-like head and adapted to engage the aperture of said door or lid for retention purposes.

* * * * *